United States Patent [19]

Nogami et al.

[11] Patent Number: 5,010,946

[45] Date of Patent: Apr. 30, 1991

[54] DIE CASTING CYLINDER

[75] Inventors: Shingo Nogami; Toshinori Yashiro; Toshio Okitsu; Kiyoshi Furushima; Itsuo Korenaga, all of Kitakyusyu, Japan

[73] Assignee: Hitachi Metals, Ltd., Tokyo, Japan

[21] Appl. No.: 368,393

[22] PCT Filed: Oct. 6, 1988

[86] PCT No.: PCT/JP88/01018

§ 371 Date: Jun. 6, 1989

§ 102(e) Date: Jun. 6, 1989

[87] PCT Pub. No.: WO89/03263

PCT Pub. Date: Apr. 20, 1989

[30] Foreign Application Priority Data

Oct. 7, 1987 [JP] Japan ..... 62-253198
Jun. 14, 1988 [JP] Japan ..... 63-78384

[51] Int. Cl.[5] ..... B22D 17/10; B22D 17/20
[52] U.S. Cl. ..... 164/312; 164/303
[58] Field of Search ..... 164/312, 303, 316

[56] References Cited

U.S. PATENT DOCUMENTS 3,664,411 5/1972 Garver ..... 164/312
3,685,572 8/1972 Carver et al. ..... 164/312

FOREIGN PATENT DOCUMENTS 50-31533 10/1975 Japan .
52-44726 4/1977 Japan .
53-70034 6/1978 Japan .
53-131231 11/1978 Japan ..... 164/303
53-140710 11/1978 Japan .
56-6770 1/1981 Japan ..... 164/316
56-109150 8/1981 Japan .
58-16765 1/1983 Japan ..... 164/312
61-67555 4/1986 Japan .
61-103658 5/1986 Japan .
61-119367 6/1986 Japan ..... 164/312
61-177758 11/1986 Japan .
63-66555 5/1988 Japan .

*Primary Examiner*—Richard K. Seidel
*Assistant Examiner*—J. Reed Batten, Jr.
*Attorney, Agent, or Firm*—Finnegan, Henderson, Farabow, Garrett & Dunner

[57] ABSTRACT

The die casting cylinder includes an outer cylindrical member made of a metal and a ceramic inner cylindrical member, in a boundary between which a plurality of voids are provided. The voids are preferably grooves provided in an inner surface of the outer cylindrical member of in an outer surface of the inner cylindrical member, with a width "a" and a distance "b" satisfying an a/b ratio of 1:1-6:1.

5 Claims, 3 Drawing Sheets

DIE CASTING CYLINDER

FIELD OF THE INVENTION

The present invention relates to a molten metal-injecting cylinder in a die casting machine for nonferrous metals such as aluminum alloys, and more particularly to a die casting cylinder of a composite structure comprising an outer cylindrical member made of a metal material and an inner cylindrical member made of a ceramic material and fixed in the outer cylindrical member.

BACKGROUND OF THE INVENTION

In general, a cold chamber-type die casting machine comprises as an injection means a horizontal cylinder having an inlet opening in an upper side wall thereof near its end, and a charge of molten metal is introduced into the cylinder through the inlet opening and injected into a die cavity communicating with the cylinder by means of a piston slidably moving in the cylinder. Since the molten metal directly drops onto and collides with the inner surface of the cylinder particularly just below the inlet opening, it is likely that the inner surface of the cylinder is subjected to erosion in such a portion, and that it is worn by sliding contact with the piston. When the inner surface of the cylinder is damaged by these erosion and wear cycles, the molten metal can leak into a gap between the cylinder and the piston, resulting in an increase in the sliding resistance of the piston. This in turn reduces the injection rate, which leads not only to the deterioration of qualities of injection products but also to the reduction of productivity and to a further increase in damage of the inner surface of the cylinder. If a large amount of a lubricating agent is used to reduce the sliding resistance between the cylinder and the piston and to prevent seizure, it could be entrained into the molten metal as an impurity, resulting in the deterioration of product quality.

In view of these problems, cylinders made of nitrided steel having a hardness of $H_RC$ 65 ($H_V$832) or so have conventionally been used. The use of such nitrided steel decreases the wear and erosion of the inner surface of the cylinder, but nitrided steel is still unsatisfactory in terms of the durability of the cylinder and the quality of products cast by using such a cylinder.

Accordingly, various proposals have been made to provide a die casting cylinder in which a heat-resistant, wear-resistant ceramic cylinder is fixed in a steel cylinder, into which a piston is inserted.

U.S. Pat. No. 3,664,411 discloses a die casting cylinder comprising a metal casing and a ceramic liner having good resistance to corrosion by molten metals and thermal fatigue resistance, the ceramic liner affording an external surface of slightly tapered form and the casing affording an internal surface having a taper complementary to that of the liner, whereby the liner and the casing are assembled together as a press fit so that the liner is supported by the casing at all positions along its length.

Japanese Patent Laid-Open No. 53-70034 discloses a die casting apparatus comprising a melt injection cylinder in which a plurality of separate ceramic sleeve pieces are assembled.

Japanese Patent Laid-Open No. 61-67555 discloses an injection sleeve for die casting, having a dual structure consisting of an inner cylinder and an outer cylinder, between which a water-cooling jacket is provided.

Further, Japanese Patent Laid-Open No. 61-103658 discloses an injection cylinder for a die casting machine comprising a cylinder body into which a piston is inserted, and an inner cylinder made of a nonferrous metal material having extremely high heat resistance and wear resistance such as a ceramic or a cermet, which is fit under proper pressure in the cylinder body at least near an inlet opening for a molten metal, the cylinder body being provided with at least one path for introducing a heating medium.

The above-mentioned structures in which ceramic inner cylinders are fit in the cylinder bodies are extremely effective for improving the wear resistance and corrosion resistance of the cylinders, but there is still a room for improvement in that the temperature of the molten metal introduced into the cylinders is lowered. In a die casting method, since casting is generally carried out under the conditions that the temperature of a molten metal is as close to its solidification temperature as possible, it is required that the cylinder has high heat insulation, namely, high temperature-keeping property in addition to the above properties to prevent the temperature decrease of the molten metal. In this respect, the cylinder having a ceramic inner cylinder fixed thereto has slightly improved heat resistance and temperature-retaining properties as compared to conventional steel cylinders, but it still fails to satisfy the requirements in the die casting method.

In addition, when the molten metal is introduced into the cylinder, a lower portion of the cylinder, which is brought into contact with the molten metal, is preferentially heated. Accordingly, because of the difference in thermal expansion between the lower and upper portions of the cylinder, the cylinder tends to be warped upward. As a result, cracking and breakage are likely to take place in the ceramic inner cylinder.

DISCLOSURE OF THE INVENTION

To solve the problem last mentioned above, it is necessary to improve its heat insulation and temperature-retaining properties. Specifically speaking, if the ceramic inner cylinder, which is subjected to temperature increase by contact with the molten metal, is sufficiently heat-insulated from the metal outer cylinder, the outer metal cylinder undergoes little temperature increase, so that the warping of the cylinder due to the difference in thermal expansion can be minimized.

In view of the above, an object of the present invention is to provide a cylinder for use in a composite-type die casting machine comprising a ceramic inner cylindrical member and a metal outer cylindrical member, whose heat insulation and temperature-retaining properties are improved.

The die casting cylinder of the present invention is characterized by comprising a metal outer cylindrical member and a ceramic inner cylindrical member, in a boundary between which a plurality of voids are provided.

BRIEF DESCRIPTION OF THE DRAWINGS

FIG. 5 (*b*) is a partial cross-sectional view showing a metal outer cylindrical member whose inner diameter is reduced in a front end portion 1 of the cylinder:

THE BEST MODE OF CARRYING OUT THE INVENTION

Figure 1:
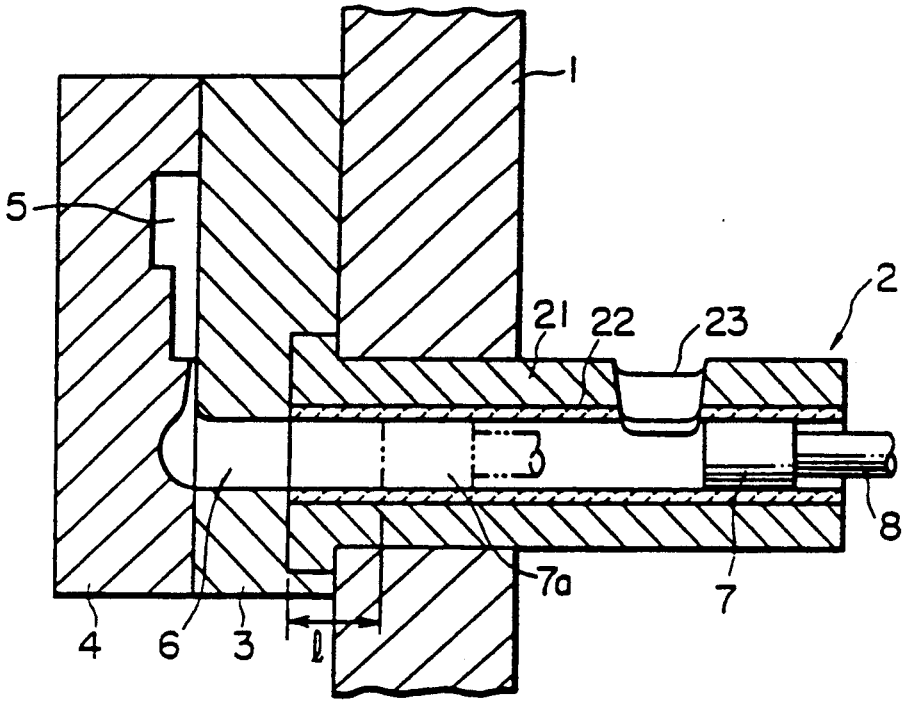
FIG. 1 is a vertical cross-sectional view showing a die casting machine having a die casting cylinder according to one embodiment of the present invention.

FIG. 1 shows a die casting machine having a die casting cylinder according to one embodiment of the present invention. The die casting machine comprises a stationary support 1, a cylinder 2 detachably fixed to the stationary support 1, a stationary die 3 fixed to the stationary support 1, and a movable die 4 movable relative to the stationary die 3. The movable die 4 is provided with a cavity 5, and the stationary die 3 is provided with a sprue 6 communicating between the cavity 5 and the cylinder 2.

The cylinder 2 is constituted by a metal outer cylindrical member 21 and a ceramic inner cylindrical member 22, and is provided with an inlet opening 23 for a molten metal in its upper side wall near a rear end portion thereof. A piston tip 7 is slidably inserted into the cylinder 2 from its rear end. The piston tip 7 slides back and forth in the cylinder 2 by means of a piston rod 8.

In the cylinder 2 of such structure, the molten metal is introduced into the cylinder 2 through the inlet opening 23, and pushed toward the die by the piston tip 7 (see 7*a*). The molten metal is pushed into the die cavity 5 by the piston tip 7 and solidified therein to provide a die-cast product of a desired shape.

Figure 2:
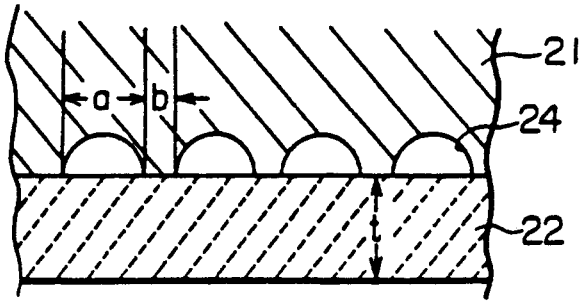
FIG. 2 is a partially enlarged cross-sectional view showing voids provided in a boundary between a metal outer cylindrical member and a ceramic inner cylindrical member of the die casting cylinder according to one embodiment of the present invention.

In the present invention, a plurality of voids 24 are provided in a boundary between the metal outer cylindrical member 21 and the ceramic inner cylindrical member 22. FIG. 2 shows a preferred example, in which each void 24 is in the shape of a groove having a semicircular cross section, with a width "a" (diameter of the semicircular cross section) and a distance "b" between the adjacent voids 24 satisfying the following relation:

$$a/b = 1:1\text{–}6:1. \quad (1)$$

As the ratio a/b nears 1, the voids 24 show smaller heat insulation effect (temperature-retaining effect), and when a/b is smaller than 1:1, the above effects are insufficient. On the other hand, as a/b becomes larger, a larger shearing force is applied to the ceramic inner cylindrical member 22 by a compression force due to the shrinkage fit of the outer cylindrical member 21 to the ceramic inner cylindrical member 22. To prevent the breakage of the inner cylindrical member 22, the upper limit of a/b is 6:1.

On the other hand, with respect to the relation between the thickness "t" of the ceramic inner cylindrical member 22 and the width "a" of each void 24, it is preferable to meet the following relation:

$$a \leqq t \quad (2)$$

When $a > t$, too much shearing force is applied to the ceramic inner cylindrical member 22, making it likely that the inner cylindrical member 22 is destroyed. On the other hand, when the voids 24 are too small, sufficient heat insulation and temperature retention cannot be achieved even though the above requirements are met. Therefore, the width (diameter) "a" of the void 24 is desirably 1 mm or more.

Incidentally, the voids 24 are preferably grooves, which may be constituted by a plurality of circular grooves, or by a spiral groove. Alternatively, they may be a plurality of grooves extending longitudinally along the cylinder. In any case, the above requirements (1) and (2) are desirably met.

Figure 3:
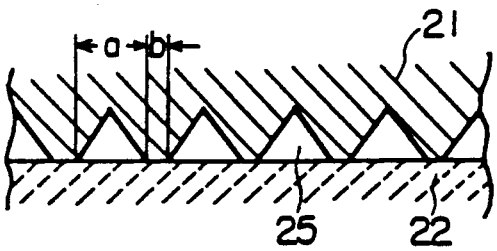
FIG. 3 is a partially enlarged cross-sectional view showing voids according to another embodiment of the present invention.

FIG. 3 shows voids 25 according to another embodiment of the present invention. In this embodiment, each void 25 is of a triangular cross section, and as in FIG. 2, they may be constituted by separate circular grooves, a spiral groove or longitudinal grooves.

FIGS. 2 and 3 show the preferred shapes of the grooves, but the present invention is not restricted thereto, and the voids may be constituted by grooves having various cross sections such as a rectangular cross section, a square cross section, a trapezoidal cross section, etc.

Incidentally, with respect to the width "a" of each groove and the distance "b" therebetween which should satisfy the above requirements (1) and (2), they are preferably as follows: 1–6 mm for the width "a" of each groove, 1–3 mm or so for the distance "b" between the adjacent grooves, and 0.2–1 mm for the depth of each groove.

The above-described voids preferably exist along the entire length of the boundary between the metal outer cylindrical member 21 and the ceramic inner cylindrical member 22, but they may be provided only in a portion where a large temperature increase takes place. Also, the voids are preferably formed in an inner surface of the metal outer cylindrical member because of easiness of working, but they may be formed in an outer surface of the ceramic inner cylindrical member as the case may be.

Figure 4A:
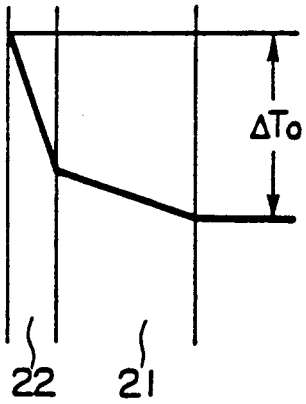
FIG. 4 is a graph showing a temperature decrease of the ceramic inner cylindrical member and the metal outer cylindrical member, in which (a) shows a case where there are no voids, and (b) shows a case where there are voids.
Figure 4B:
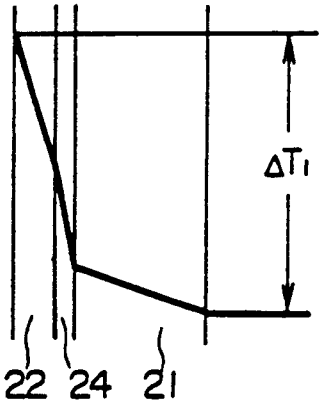

FIG. 4 shows the heat insulation and temperature retention effects of the voids. As shown in FIG. 4 (*a*), when there are no voids, the inner surface of the ceramic inner cylindrical member 22 and the outer surface of the metal outer cylindrical member 21 experience an insufficient temperature difference $\Delta T_0$. However, in the case where there are voids 24 (in FIG. 4 (*b*)), the temperature difference $\Delta T_1$ is sufficiently large due to the heat insulation and temperature retention effects. It is clear from a comparison between FIG. 4 (*a*) and FIG. 4 (*b*) that the temperature of the metal outer cylindrical member is much lower in FIG. 4 (*b*) than in FIG. 4 (*a*). Accordingly, in the case of FIG. 4 (*b*), the metal outer cylindrical member is subjected to only small thermal expansion, resulting in the reduced warping of the cylinder, which in turn reduces the likelihood of the breakage of the ceramic inner cylindrical member 22.

Next, the outer cylindrical member 21 and the inner cylindrical member 22 are fixed by shrinkage fit at a shrinkage fit ratio of 1/1000–6/1000, and this construction serves to prevent the loosening between the inner cylindrical member 22 and the outer cylindrical member 21 by different thermal expansions when the molten metal is introduced. When the piston 7 is operated after introducing the molten metal into the inner cylindrical member 22 shown in FIG. 1, the inner cylindrical member 22 is filled with the molten metal. Accordingly, the inner cylindrical member 22 is thermally expanded, and the outer cylindrical member 21 is also expanded by heat conduction. In this case, since the metal outer cylindrical member 21 has a larger thermal expansion coefficient than the ceramic inner cylindrical member 22, the shrinkage fit is loosened when heated because of the difference in thermal expansion between them. However, since the shrinkage fit ratio is set to absorb this difference in thermal expansion, the loosening of the shrinkage fit between the outer cylindrical member 21 and the inner cylindrical member 22 can be prevented even though they undergo different thermal expansions by heating. Further, in the cylinder of the present invention, since the boundary between the inner cylindrical member 22 and the outer cylindrical member 21 is provide with voids 24 serving to provide the cylinder with heat insulation and temperature retaining characteristics, the outer cylindrical member 21 undergoes only small temperature increase, resulting in small thermal expansion. Thus, a further improved function of preventing the loosening between them can be achieved.

In addition, since a compression force applied to the inner cylindrical member 22 by the above shrinkage fit ratio serves to offset a tensile stress applied to the inner cylindrical member 22 by the pressure of the molten metal injected by the piston, the cracking of the inner cylindrical member 22 due to the above tensile stress can be prevented.

Figure 5A:
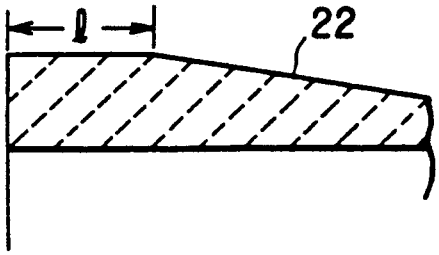
FIG. 5 (*a*) is a partial cross-sectional view showing a ceramic inner cylindrical member whose outer diameter is expanded in a front end portion 1 thereof.
Figure 5B:
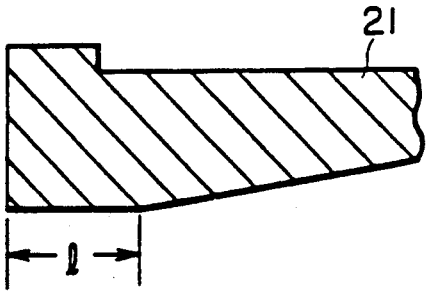

FIGS. 5 (*a*) and 5 (*b*) are cross-sectional views schematically showing the shapes of an inner cylindrical member 22 and an outer cylindrical member 21 according to a further embodiment of the present invention. In FIG. 5 (*a*), the inner cylindrical member 22 has a front end portion l having an expanded outer diameter, and the other portion has a gradually decreasing outer diameter. On the other hand, an outer cylindrical member (not shown) has a constant inner diameter along its entire length, so that in the range of the front end portion l, sufficient fit ratio (shrinkage fit ratio), for instance, 2/1000–6/1000, can be achieved to reinforce the inner cylindrical member 22. Accordingly, the fit ratio in the other portion than the above front end portion l is much smaller than the above range.

By the above structure, sufficient fit ratio between the inner and outer cylindrical members can be achieved in the region of the above front end portion l to which an injection pressure is applied, thereby exerting a reinforcing action to the inner cylindrical member 22. Accordingly, the generation of tensile stress in the inner cylindrical member 22 due to the application of an injection pressure, the difference in thermal expansion and other causes can be effectively prevented, thereby preventing the cracking of the ceramic inner cylindrical member 22. With respect to a fit ratio in the other portion than the above front end portion, since it is smaller than that in the above range l, the cracking of the inner cylindrical member 22 near the inlet opening 23 can be prevented. In addition, the cylinder 2 is heated particularly in its lower portion during the period between the introduction and the injection of the molten metal. As a result, the outer cylindrical member 21 and the inner cylindrical member 22 undergo different thermal expansion. However, since the fit ratio between the inner and outer cylindrical members is small, the above difference in thermal expansion can be fully absorbed, thereby preventing the generation of undesirable thermal stress.

FIG. 5 (*b*) shows an outer cylindrical member 21 whose inner diameter is constant in its front end portion l and is gradually increasing in the other portion. In this case, an inner cylindrical member (not shown) has a constant outer diameter along its entire length. Therefore, in the range of the above front end portion l, a sufficient fit ratio to reinforce the inner cylindrical member can be achieved. In such a structure, the same reinforcing function as in FIG. 5 (*a*) is obtained.

The above structures not only sufficiently reinforce the inner cylindrical member made of ceramic materials but also provide a reduced compression force to the inner cylindrical member to which an injection pressure is not applied. As a result, the cracking of the inner cylindrical member near the inlet opening can be completely prevented. This makes sure that the properties such as wear resistance, corrosion resistance, heat resistance, etc. inherent in the ceramic materials can fully be exhibited, thereby contributing to improving the durability of the die casting sleeve, the yield of die-cast products, and the reduction of energy costs.

Figure 6:
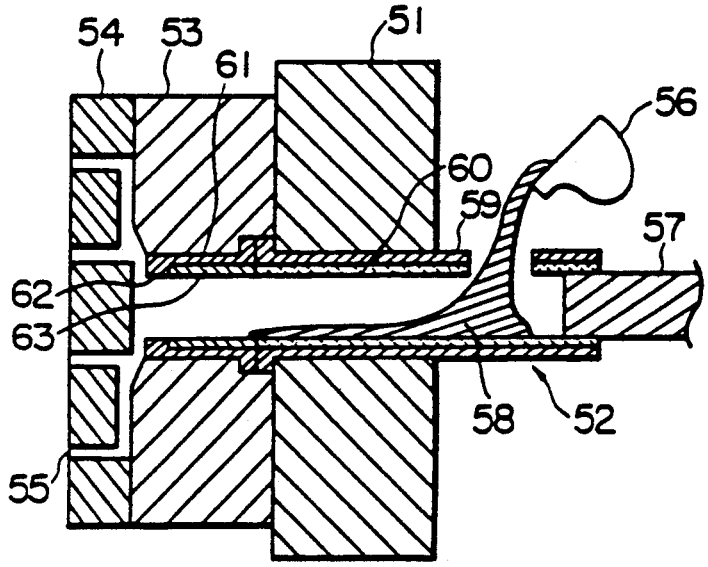
FIG. 6 is a vertical cross-sectional view showing a die casting machine having a die casting cylinder according to a further embodiment of the present invention.

FIG. 6 shows a die casting cylinder according to a still further embodiment of the present invention, which has a metal inner cylindrical member in the front end portion thereof. The die casting cylinder 52 is detachably fixed to a stationary support 51, and a stationary die 53 is fixed to the stationary support 51, and a movable die 54 is movable toward and apart from the stationary die 53. The cylinder 52 consists of a metal outer cylindrical member 59 and a ceramic inner cylindrical member 60, and a front end portion of the cylinder 52 consists of a metal outer cylindrical member 61 having a flange 62 and a metal inner cylindrical member 63.

A molten metal 58 is introduced into the cylinder by a ladle 56, and forced into a cavity 55 by a piston 57. In this case, since the molten metal 58 pushed by the piston 57 has extremely increased pressure in the front end portion of the cylinder, the inner cylindrical member may be broken. Accordingly, to completely prevent the breakage of the front end portion, it is preferable to use a metal inner cylindrical member in the front end portion. Also, by making the inner cylindrical member of a metal in the front end portion, the molten metal is more quickly cooled, thereby reducing the solidification time of the molten metal in the cavity, which in turn shortens a die casting cycle.

Figure 7:
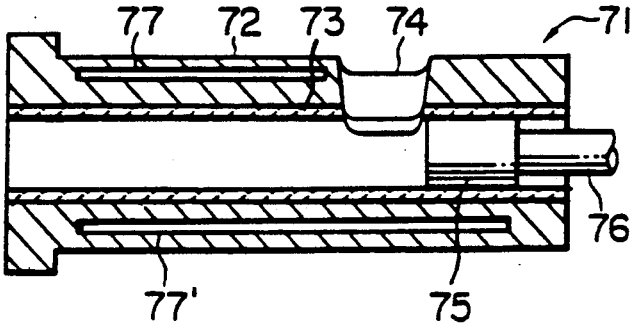
FIG. 7 is a vertical cross-sectional view showing a die casting cylinder according to a still further embodiment of the present invention.

FIG. 7 shows a die casting cylinder 71 having water paths 77 and 77' in a metal outer cylindrical member 72 to prevent the temperature increase of the metal outer cylindrical member 72. As in FIG. 1, this cylinder 71 has a metal outer cylindrical member 72, a ceramic inner cylindrical member 73, an inlet opening 74, and a piston tip 75 fixed to a front end portion of a piston rod 76, which is slidable in the cylinder. The water paths 77 and 77' may be in a spiral shape or may extend longitudinally along the cylinder. In the case of longitudinal water paths, each end of adjacent water paths is connected to each other, so that they may form a single water path as a whole. Cooling effect can be improved by providing two or more water inlets and outlets to the water paths.

For the ceramic inner cylindrical members constituting the die casting cylinders of the above-described structures, various types of ceramics can be used, but from the aspect of heat resistance, seizure resistance, thermal shock resistance, etc., silicon nitride ceramics and sialon are preferable.

Typical compositions of the silicon nitride ceramics or sialon consist essentially of 70 weight % or more of $Si_3N_4$, 20 weight % or less of one or more oxides of elements belonging to Groups IIa or IIIa of the Periodic Table, 20 weight % or less of $Al_2O_3$, and 10 weight % or less of AlN solid solutions ($AlN$-$Si_3N_4$-$Al_2O_3$) or AlN, and the cylinders can be produced by sintering mixtures of these components. The inner cylindrical member of silicon nitride or sialon may be produced by pressing a starting material powder to form a green body by a cold isostatic press, sintering it at normal pressure and then working it to the desired dimension. The resulting ceramic inner cylindrical member has a bending strength of 50 kg/mm$^2$ or more, a density of 90% or more based on the theoretical one, and a thermal shock resistance temperature $\Delta T$ of 300° C. or more when measured by a water quenching method.

Incidentally, although the outer cylindrical member is preferably made of tool steel, it may be made of structural steel, alloy steel, nonferrous metals, etc.

EXAMPLE 1

To an inner cylindrical member (outer diameter: 75 mm, inner diameter: 60 mm, length: 230 mm) made of sialon consisting essentially of 87 weight % of $Si_3N_4$, 6 weight % of $Y_2O_3$, 4 weight % of $Al_2O_3$ and 3 weight % of an AlN solid solution, was fixed an outer cylindrical member (outer diameter: 115 mm, inner diameter 75 mm, length 250 mm) made of SKD-61 by shrinkage fit. Incidentally, the outer cylindrical member was provided in its inner surface with circular grooves each having a semicircular cross section (width: 2 mm, depth: 0.5 mm) at 1-mm intervals. The cylinder thus constructed was provided with an inlet opening for a molten metal in its upper wall near a rear end portion thereof.

The cylinder of this structure was mounted to a die casting machine as shown in FIG. 1 (clamping force: 800 t), and with an aluminum alloy melt at 760° C., die casting was carried out under the casting conditions of a casting cycle of 72 seconds and a solidification time of 20 seconds. As a result, the cylinder withstood 100,000 or more of shots (molten metal charges) without suffering from substantial damage. It was further confirmed that the cylinder showed extremely good heat insulation and temperature retaining effects.

EXAMPLE 2

An inner cylindrical member and an outer cylindrical member were respectively produced from the same sialon and SKD-61 as in Example 1, and the outer cylindrical member was provided with an inner surface shape as shown in FIG. 5 (*b*), so that the fit rate between the outer and inner cylindrical members was 4/1000 in the front end portion 1 of the cylinder and 4/1000–1.5/1000 in the other portion.

With the cylinder of this structure, die casting was carried out under the same conditions as in Example 1. As a result, it withstood 150,000 or more of shots without causing any cracks near the inlet opening.

APPLICATION IN INDUSTRIES

The die casting cylinder of the present invention shows excellent heat insulation and temperature retention properties because of voids in the boundary between the metal outer cylindrical member and the ceramic inner cylindrical member. Accordingly, since the temperature increase of the metal outer cylindrical member can be suppressed after introduction of a molten metal, the difference in thermal expansion can be kept small between a lower portion of the cylinder with which the molten metal is contacted and an upper portion of the cylinder with which the molten metal is not contacted. As a result, the upward warping of the cylinder can be effectively prevented. This in turn effectively prevents the breakage of the ceramic inner cylindrical member.

In addition, due to its heat insulation and temperature retention effects, misrun can be prevented even for cast products having thin portions, thereby providing high-quality die-cast products.

In addition, since there is no need of elevating the temperature of the molten metal, the oxidation of the molten metal, the increase of gas content and other defects which were conventionally experienced by heating to very high temperatures can be drastically decreased.

Further, since the breakage of the ceramic inner cylindrical member is prevented, the overall cylinder can enjoy drastically increased service life.

The die casting cylinder of the present invention having the above features is suitable for cold chamber-type die casting machines for nonferrous metals such as aluminum alloys.

We claim:

1. A die casting cylinder comprising an outer cylindrical member made of a metal and a ceramic inner cylindrical member, in a boundary between which a plurality of voids are provided, wherein said voids are grooves provided in an inner surface of said outer cylindrical member or in an outer surface of said inner cylindrical member, the width "a" of each groove and the distance "b" between the adjacent grooves satisfying an a/b ratio of 1:1–6:1.

2. The die casting cylinder according to claim 1, wherein a fit ratio of said outer cylindrical member to said inner cylindrical member is larger in a front end portion of said cylinder on the side of a die cavity, to which an injection pressure is applied, than in the other portion of said cylinder.

3. The die casting cylinder according to claim 1, wherein an inner portion of said cylinder is made of a metal in a front end portion of said cylinder on the side of a die cavity.

4. The die casting cylinder according to claim 1, wherein paths for cooling water are provided in said outer cylindrical metal member.

5. The die casting cylinder according to claim 1, wherein said ceramic inner cylindrical member is made of a silicon nitride ceramic or sialon, having a bending strength of 50 kg/mm$^2$ or more, a density of 90% or more based on the theoretical density, and a thermal shock resistance temperature $\Delta T$ of 300° C. or higher.

* * * * *